US006842996B2

(12) United States Patent
Szarka

(10) Patent No.: US 6,842,996 B2
(45) Date of Patent: Jan. 18, 2005

(54) SEGMENTED AIR DISTRIBUTION BAR

(75) Inventor: Sandor Szarka, Franklin Lakes, NJ (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 10/650,221

(22) Filed: Aug. 28, 2003

(65) Prior Publication Data

US 2004/0107851 A1 Jun. 10, 2004

Related U.S. Application Data

(60) Provisional application No. 60/407,367, filed on Aug. 31, 2002.

(51) Int. Cl.[7] ..... F26B 21/06

(52) U.S. Cl. ..... 34/83; 34/84; 34/633; 34/638; 34/641; 34/655

(58) Field of Search ..... 34/83, 84, 633, 34/638, 641, 655, 656

(56) References Cited

U.S. PATENT DOCUMENTS

| | | | | |
|---|---|---|---|---|
| 4,524,689 A | | 6/1985 | Lemaster | |
| 5,070,627 A | * | 12/1991 | Zagar | 34/641 |
| 5,085,142 A | | 2/1992 | Smith | |
| 5,105,562 A | * | 4/1992 | Hella et al. | 34/643 |
| 5,313,685 A | | 5/1994 | Kramer et al. | |
| 5,395,029 A | * | 3/1995 | Kurie | 34/641 |
| 5,454,310 A | | 10/1995 | Hayes | |
| 5,490,300 A | | 2/1996 | Horn | |
| 5,491,602 A | | 2/1996 | Horn et al. | |
| 5,924,619 A | * | 7/1999 | Bartell | 226/7 |

* cited by examiner

*Primary Examiner*—Jiping Lu
(74) *Attorney, Agent, or Firm*—Dinsmore & Shohl LLP

(57) ABSTRACT

An air-knife is described in the form of a segmented air distribution bar equipped with control valves along the length of the bar to enable a user to incrementally adjust the air distribution across the width of an inking roller of a printing press.

3 Claims, 5 Drawing Sheets

SEGMENTED AIR DISTRIBUTION BAR

This application claims benefit of U.S. Provisional 60/407,367 filed Aug. 31, 2002.

BACKGROUND OF THE INVENTION

1. Field of the Invention

The subject invention relates generally to a segmented air distribution bar and, more particularly, to a segmented air distribution bar having air control valves along the length of the bar to enable a user to incrementally adjust the amount of air that is distributed across the width of a roller in a printing press.

2. Background of the Related Art

During offset printing it is not uncommon to develop a build-up of excess dampening solution in the ink on the rollers of the printing press. Its occurrence is inherent to the printing process. Such a build-up, however, does not occur evenly across the width of the rollers. When an excessive amount of dampening solution is picked up by ink, it becomes water logged and breaks down. This is commonly called over-emulsification. The results are extreme ghosting and loss of color density in the print, mottled print, ink piling on the inked rollers, and sheet curl resulting in misregistration and paper feed problems. To eliminate the problems, press operators will usually have to clean the entire ink train and dampener and then replenish the ink and dampening solution fountains. This work stoppage results in product delivery delays and measurable economic loss.

Attempts have been made to prevent excess dampening solution buildup and/or remove the excess dampening solution from over emulsified ink. One method is to install an air bar that directs a stream of air against the surface of one or more inked rollers to force evaporation of excess solution. Two inventions that exemplify this method are disclosed in U.S. Pat. No. 4,524,689 to Lemaster and U.S. Pat. No. 5,085,142 to Smith. Other attempts have been made to prevent excess dampening solution buildup and/or remove the excess dampening solution from over emulsified ink as exemplified in U.S. Pat. No. 5,454,310 to Hayes.

The present invention incorporates a so-called "air-knife" or "air amplifier" of the sort which drives a relatively small volume of air along a wall surface, such that the air adheres to that wall surface. This phenomenon is called the "coanda" effect. This small volume of air creates suction in the adjacent air which pulls in very high volumes of air along with the relatively small volume of air. Amplifications of air volumes on the order of 30 to 1 may be achieved with such air amplifiers.

The structure necessary to achieve the coanda effect includes essentially a thin, elongated slot or nozzle formed in a housing member adjacent to a wall face that curves around a bend. Typically, this bend can be up to 90 degrees. A relatively high-velocity, relatively low-volume air flow is driven along that curved wall face from the slot. By maintaining the slot to a desired relatively thin opening, and by controlling the contour of the wall face, it is possible to ensure that the relatively high-velocity, relatively low-volume air adheres to the wall face and is driven around the curve of the wall face. This, in turn, creates a suction adjacent to the slot which entrains a relatively high quantity of air.

The structure of the amplifier itself is known to those of ordinary skill in the art, and is commonly available on the market. One such amplifier is available under the trade name Exair Air Knife from Exair Corporation (Cincinnati, Ohio). Those of ordinary skill in the art will be aware of the dimensions and parameters of operation necessary to create the coanda effect and resulting air amplification results.

A device that makes use of the coanda effect is disclosed in U.S. Pat. No. 5,313,685, to Sundwiger Eisenhutte, the contents of which are incorporated by reference herein. The device is for removing liquid from the surface of a moving steel strip by means of air blown onto the moving strip from a device having a slot nozzle which is disposed transversely to the direction in which the strip is moving and is directed at the surface of the strip at an angle of between about 45 and 90 degrees opposite to the direction of the strip movement. The device further includes a means for suctioning off any liquid that is removed from the surface of the strip.

Another device that makes use of the coanda effect is disclosed in U.S. Pat. No. 5,490,300, to Paul Horn, the contents of which are incorporated by reference herein. The device is disposed adjacent to a web of material that is to be cleaned. A relatively small volume of compressed air is driven from a slot onto a curved wall surface. The coanda effect causes that compressed air to adhere to the wall, and causes a suction creating a relatively high-volume air flow upstream from the slot to be drawn along with the small volume of air adhering to the wall. The high-volume amplified flow of air is drawn along the surface of a web of material to be cleaned to entrain impurities from the web of material to be cleaned. A vacuum source is mounted adjacent to the end of the wall such that impurities are drawn into the vacuum source and removed from the area. In addition, ionized particles are directed into the relatively high-volume air flow to increase the cleaning efficiency of the system.

Another device that makes use of the coanda effect is disclosed in U.S. Pat. No. 5,491,602, to Paul Horn, et al., the contents of which are incorporated by reference herein. More particularly, disclosed is an air amplifier system incorporating an ionizing device including a converter driven by the compressed air being directed to an air distributor. The converter provides the power source for the ionizing apparatus. In this way, the air distributor and ionizing apparatus can be an easily contained unit. The system may comprise a turbine which is electrically connected to an ionizing apparatus, such as an ionizing bar.

BRIEF DESCRIPTION OF THE DRAWINGS

So that those of ordinary skill in the art to which the subject invention pertains will more readily understand how to make and use the segmented air distribution bar described herein, preferred embodiments of the invention will be described in detail with reference to the following drawings.

DETAILED DESCRIPTION OF THE PREFERRED EMBODIMENTS

The present invention incorporates a so-called "air-knife" or "air amplifier" of the sort that takes advantage of the coanda effect, which drives a relatively small volume of air along a wall surface, such that the air adheres to that wall surface. This small volume of air creates suction in the adjacent air which pulls in very high volumes of air along with the relatively small volume of air. Amplifications of air volumes on the order of 30 to 1 may be achieved with such air amplifiers. Existing systems that incorporate air-knives, such as disclosed in U.S. Pat. No. 5,490,300 and U.S. Pat. No. 5,491,602, are lacking in that they do not provide a way to alter the flow of the air across the width of the air bar. This is a significant disadvantage in that there are a number of applications that require such control of the air flow in order to benefit from an air bar. One such application is control of excess fountain solution build-up in ink on the rollers of a printing press. It is well known by those having ordinary skill in the art that such buildup does not occur evenly across the rollers.

Each printing head of an off-set lithographic printing press consists of several basic components and assemblies: an ink train, a dampening system, a printing plate and plate cylinder, a blanket and blanket cylinder, and an impression cylinder. These components and assemblies cooperate to lay the proper ink image and ink film thickness on the sheet or web.

Figure 1:
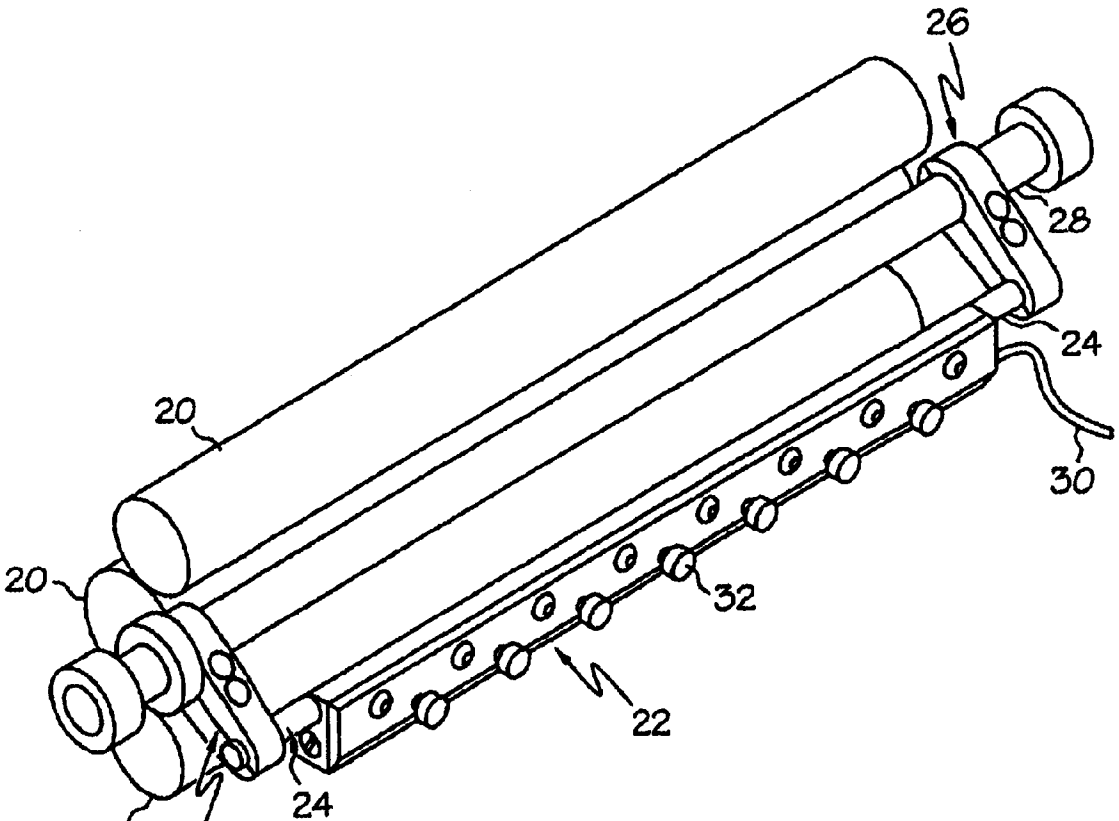
FIG. 1 is a perspective view of a portion of a printing head (3 inking rollers) of a printing press, a segmented air distribution bar ("air bar"), and a mechanism for attaching the air bar to a printing press.

FIG. 1 is a perspective view of three (3) inking rollers 20 from a portion of a printing head. Those of ordinary skill in the art will appreciate that such rollers are attached to the sideframes of the printing head by roller carriers, which may be either fixed to the sideframe or moveable to allow the rollers to be separated when the printing head is not in use.

An air bar 22 is mounted adjacent to the inking rollers 20 with two (2) pivot studs 24, two (2) clamping arms 26 and a tie rod 28. The tie rod 28 is rigidly mounted to the sideframes of the printing head. Air is supplied to the air bar through air supply tube 30. An operator controls the flow of air across the width of the rollers using incremental flow control adjusting knobs 32.

Figure 2:
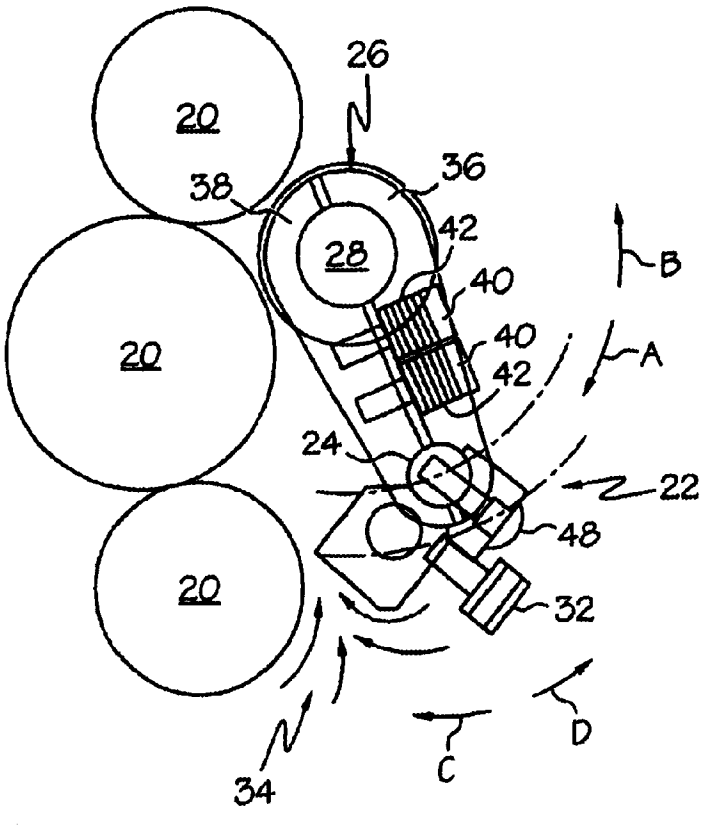
FIG. 2, taken from FIG. 1, is a side view illustrating the air bar (in cross section) assembled to the printing press with an air bar clamping arm (in cross section) and swung into the "on" position.

FIG. 2, taken from FIG. 1, is a side view illustrating the air bar 22 (in cross section) assembled to the printing head with an air bar clamping arm 26 (in cross section) and swung into the "on" position. The direction of movement that the air bar 22 is moved in order to locate it into the "on" position is identified by arrow "A". Generally, the "on" position is where the air bar is positioned sufficiently close to an inking roller 20 so that the air flow 34 caused by the air bar 22 tends to evaporate fountain solution from the emulsified ink on the inking roller 20. The air bar may be moved into an "off" position by moving the air bar 22 in the direction of the arrow identified by arrow "B".

Each clamping arm 26 includes an upper clamp 36 and a lower clamp 38. The upper clamp 36 and lower clamp 38 are attached to each other with shoulder bolts 40. Between the head of each shoulder bolt 40 and the bottom of each counterbore in which they reside is a spring 42. This configuration allows the clamping arms 26 to pivot about the tie rod 28 in the direction of arrows "A" and "B" and also allows the air bar 22 to pivot about pivot studs 24 in the direction of arrows "C" and "D". This arrangement allows a press operator to precisely position the air bar 22 in a position that is most effective in removing fountain solution from emulsified ink on the inking rollers 20.

Figure 3:
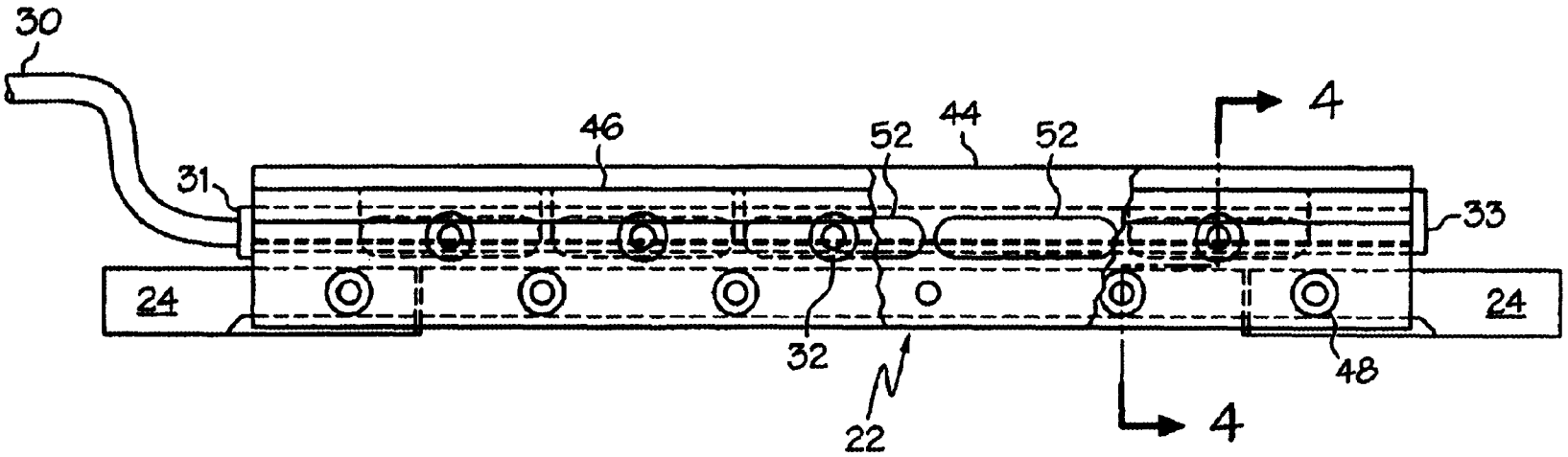
FIG. 3, taken from FIG. 1 and rotated 180 degrees, is a rear view illustrating the air bar without the air bar clamping arms, tie rod, and inking rollers.
Figure 4:
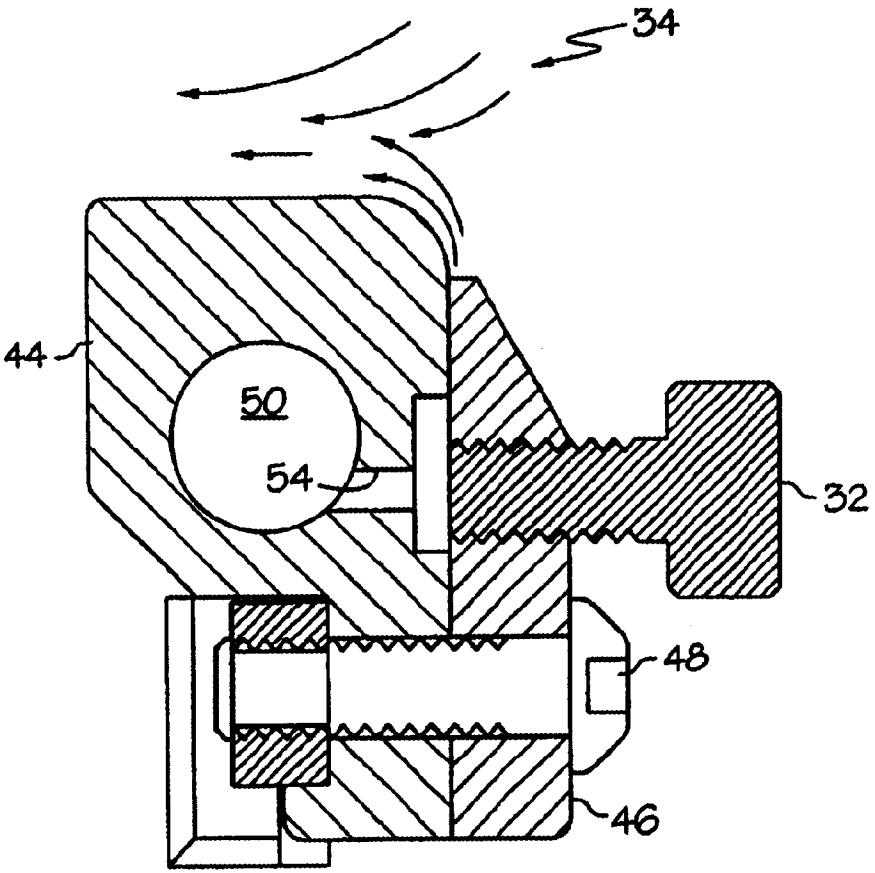
FIG. 4, taken from FIG. 3, is a cross-sectional view of the air bar.

FIG. 3, taken from FIG. 1 and rotated 180 degrees, is a rear view illustrating the air bar 22 without the air bar clamping arms 26, tie rod 28, and inking rollers 20. FIG. 4, taken from FIG. 3, is a cross-sectional view of the air bar. Considering both FIGS. 3 and 4, the air bar 22 is shown to include a body 44 to which is attached an air guide plate 46 with attachment fasteners 48. The body 44 includes a main air passageway 50 extending its length. Air is supplied to the passageway 50 through air supply tube 30 via an air tube connector 31 The opposite end of the an passageway 50 is closed off with a threaded plug 33.

Figure 5:
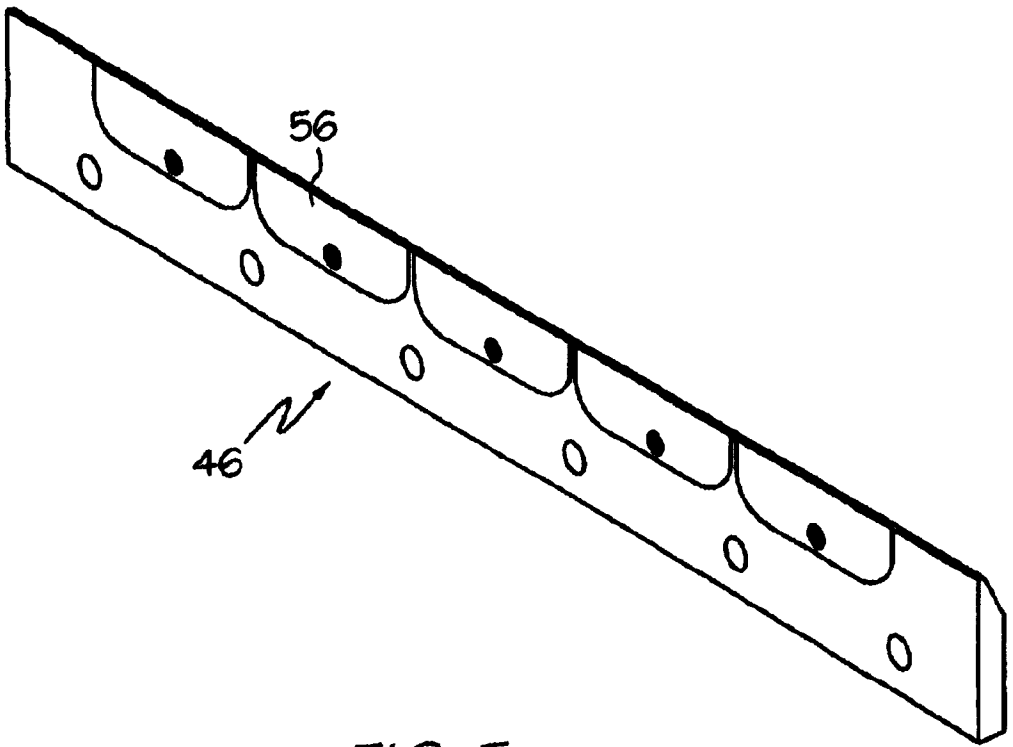
FIG. 5 is a perspective view of an air guide plate.

Body 44 further includes an air supply cavity 52 for each flow control knob 32. Each air supply cavity 52 is in fluid communication with the air passageway 50 via an air port 54. The air guide plate includes precision air gap recesses 56—one for each air supply cavity 52. FIG. 5 is a perspective view of an air guide plate showing the precision air gap recesses 56.

In operation, if a press operator decides that he has fountain solution emulsified in an inking roller 20, the operator adjusts the air bar 22 from the "off" position to the "on" position. The operator then turns the air supply on (and adjusts the pressure as necessary), which provides air through the air supply tube 30 to the air passageway 50 of the body 44. Using the flow control knobs 32, the operator may then adjust the flow of air to each segment across the width of the inking roller 20, depending on where emulsification is occurring.

A preferred embodiment of the present invention has been disclosed; however, one having ordinary skill in the art would recognize that certain modifications would come within the scope of this invention.

What is claimed is:

1. A segmented air distribution bar, comprising:

a body configured to create the coanda effect and having a passageway in fluid communication with a plurality of air supply cavities;

an air guide plate attached to the body and having an air gap for and in alignment with each of the plurality of air supply cavities, wherein the air gaps are configured to function with the body to create the coanda effect; and at least one air flow knob for each air gap, each adjustably attached to the air guide plate for adjustment of the flow of air through the air gap.

2. A segmented air distribution bar as recited in claim 1, further including two clamping arms for adjustably attaching the air distribution bar adjacent to an inking roller.

3. A segmented air distribution bar as recited in claim 2, wherein each clamping arm includes an upper clamp and a lower clamp that are secured together using biased fastening components so that the clamping arm can pivot about a tie rod and the air bar can pivot about a pivot stud without having to loosen the fasteners on the clamping arms.

* * * * *